United States Patent [19]

Polanco et al.

[11] Patent Number: 4,832,701

[45] Date of Patent: May 23, 1989

[54] PROCESS FOR THE REGENERATION OF AN ADDITIVE USED TO CONTROL EMISSIONS DURING THE COMBUSTION OF HIGH SULFUR FUEL

[75] Inventors: Domingo R. Polanco; Cebers O. Bueno; Ramón Salazar; Felix A. S. Chamorra, all of Edo. Miranda, Venezuela

[73] Assignee: Intevep, S.A., Caracas, Venezuela

[21] Appl. No.: 133,327

[22] Filed: Dec. 16, 1987

Related U.S. Application Data

[63] Continuation-in-part of Ser. No. 14,871, Feb. 17, 1987, which is a continuation-in-part of Ser. No. 875,450, Jun. 17, 1986.

[51] Int. Cl.[4] ..... C10L 1/32

[52] U.S. Cl. ..... 44/51; 44/622; 44/624; 44/627; 201/17; 423/511; 431/3; 431/4; 431/8; 431/12; 252/312

[58] Field of Search ..... 44/51, 622, 624; 201/17; 431/3, 4, 8, 12; 423/511; 252/312

[56] References Cited

U.S. PATENT DOCUMENTS

| | | | |
|---|---|---|---|
| 3,036,901 | 5/1962 | Sanders | 44/51 |
| 3,514,273 | 5/1970 | Lee et al. | 44/51 |
| 3,948,617 | 4/1976 | Withorn | 44/4 |
| 3,960,513 | 6/1976 | Agarwal et al. | 44/1 R |
| 4,226,601 | 10/1980 | Smith | 44/10 D |
| 4,396,397 | 8/1983 | Kugel et al. | 44/51 |
| 4,481,015 | 11/1984 | Lusch et al. | 44/51 |
| 4,512,774 | 4/1985 | Myers et al. | 44/51 |
| 4,526,588 | 7/1985 | Lusch et al. | 44/57 |
| 4,566,394 | 1/1986 | Boris et al. | 44/51 |

FOREIGN PATENT DOCUMENTS

| | | |
|---|---|---|
| 0013420 | of 1980 | European Pat. Off. . |
| 56-0159291 | 8/1981 | Japan . |

*Primary Examiner*—William R. Dixon, Jr.
*Assistant Examiner*—Margaret B. Medley
*Attorney, Agent, or Firm*—Bachman & La Pointe

[57] ABSTRACT

A regenerating process comprises leaching a combustion ash with water so as to dissolve same and form a pregnant leach liquor containing the additive which is separated from the solid residue. The pregnant leach liquor is thereafter adjusted with a base precipitating agent so as to precipitate a compound of the additive which is then recovered by liquid solid separation. The process of the present invention is particularly useful for regenerating said recycling sulfur capturing additives used in hydrocarbon formulations which are burned as fuels, particularly, hydrocarbon in water emulsions formed from viscous hydrocarbon materials characterized by high sulfur and metals contents.

35 Claims, 1 Drawing Sheet

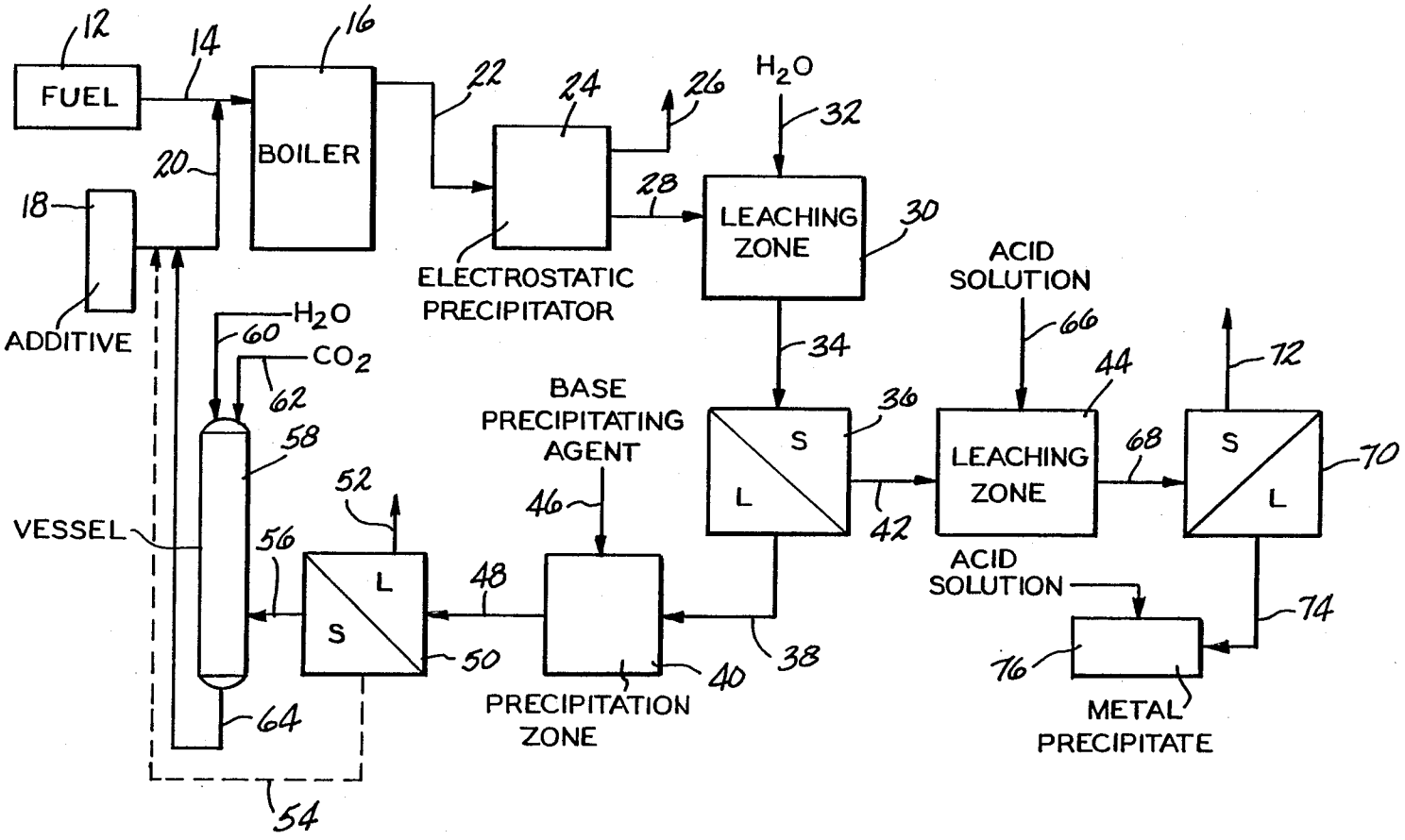
FUEL
12
14
BOILER
16
22
ELECTROSTATIC PRECIPITATOR
24
26
28
ADDITIVE
18
20
$H_2O$
32
LEACHING ZONE
30
34
S
L
36
38
42
ACID SOLUTION
66
LEACHING ZONE
44
68
S
L
70
72
74
ACID SOLUTION
METAL PRECIPITATE
76
BASE PRECIPITATING AGENT
46
PRECIPITATION ZONE
40
48
L
S
50
52
$H_2O$
60
$CO_2$
62
58
56
64
54
VESSEL

PROCESS FOR THE REGENERATION OF AN ADDITIVE USED TO CONTROL EMISSIONS DURING THE COMBUSTION OF HIGH SULFUR FUEL

CROSS REFERENCE TO RELATED APPLICATIONS

This application is related to application Ser. No. 133,323, filed concurrently herewith and is a continuation-in-part of Application Ser. No. 014,871, filed Feb. 17, 1987 which in turn is a continuation-in-part of application Ser. No. 875,450, filed June 17, 1986.

BACKGROUND OF THE INVENTION

The present invention relates to a process for the regeneration of a sulfur capturing additive used in the preparation of hydrocarbon fuels and hydrocarbon in water emulsions for combustion as fuels and, more particularly, hydrocarbon in water emulsions wherein the hydrocarbon is a low gravity, viscous hydrocarbon characterized by high sulfur and metals contents.

Low gravity, viscous hydrocarbons found in Canada, The Soviet Union, United States, China and Venezuela are normally liquid with viscosities ranging from 10,000 to 200,000 CP and API gravities of less than 12. These hydrocarbons are currently produced either by mechanical pumping, steam injection or by mining techniques. Wide-spread use of these materials as fuels is precluded for a number of reasons which include difficulty in production, transportation and handling of the material and, more importantly, unfavorable combustion characteristics including high sulfur oxide emissions and unburned solids. To date, there are two commercial processes practiced by power plants to reduce sulfur oxide emissions. The first process is furnace limestone injection wherein limestone injected into the furnace reacts with the sulfur oxides to form solid sulfate particles which are removed from the flue gas by conventional particulate control devices. The cost for burning a typical high sulfur fuel by the limestone injection method is between two to three dollars per barrel and the amount of sulfur oxides removed by the method is in the neighborhood of 50%. A more effective process for removing sulfur oxides from power plants comprises flue gas desulfurization wherein $CaO+H_2O$ are mixed with the flue gases from the furnace. In this process 90% of the sulfur oxides are removed; however, the cost for burning a barrel of fuel using the process is between four and five Dollars per barrel. Because of the foregoing, the high sulfur content, viscous hydrocarbons have not been successfully used on a commercial basis as fuels due to the high costs associated with their burning.

It is well known in the prior art to form oil in water emulsions for use as a combustible fuel. See for example U.S. Pat. Nos. 4,114,015; 4,378,230 and 4,618,348. In addition to the foregoing, the prior art teaches that oil in water emulsions formed from low gravity, viscous hydrocarbons can likewise be successfully combusted as a fuel. See for example British Patent Specification No. 974,042 and U.S. Pat. No. 4,618,348. The assignee of the instant application has discovered that sulfur-oxide emissions can be controlled when burning viscous high sulfur containing hydrocarbon in water emulsions by the addition of sulfur capturing additives to the emulsion composition. See U.S. application Ser. Nos. 875,450; 014,871 and 133,323.

Naturally, it would be highly desirable to be able to regenerate the sulfur capturing additive in order to reduce costs and increase the overall efficiency when burning oil in water emulsions.

Accordingly, it is the principle object of the present invention to provide a process for regenerating a sulfur capturing additive used in the preparation of hydrocarbon fuels for combustion, particularly, a hydrocarbon in water emulsion for combustion as a fuel.

It is a particular object of the present invention to provide a process wherein the regenerated sulfur capturing additive is recycled for further hydrocarbon in water emulsion admixing.

It is a further object of the present invention to provide a process as set forth above wherein useful by products are generated.

Further objects and advantages of the present invention will appear hereinbelow.

SUMMARY OF THE INVENTION

In accordance with the present invention the foregoing objects and advantages are readily obtained.

The present invention relates to a process for the regeneration of a sulfur capturing additive used in the preparation of hydrocarbon fuels, particularly, hydrocarbon in water emulsions for combustion as fuels and, more particularly, hydrocarbon in water emulsions wherein the hydrocarbon is a low gravity, viscous hydrocarbon characterized by high sulfur and metals contents. The process comprises leaching a combustion ash with water so as to dissolve same and form a pregnant leach liquor containing the additive which is separated from the solid residue. The pregnant leach liquor is thereafter adjusted with a base precipitating agent so as to precipitate a compound of the additive which is then recovered by liquid solid separation. The process of the present invention is particularly useful for regenerating said recycling sulfur capturing additives used in hydrocarbon formulations which are burned as fuels, particularly, hydrocarbon in water emulsions formed from viscous hydrocarbon materials characterized by high sulfur and metals contents. Other useful by products are recoverable from the process of the present invention thereby adding to the overall efficiency and economy of same.

BRIEF DESCRIPTION OF THE DRAWING

The FIGURE is a schematic illustration of the process of the present invention.

DETAILED DESCRIPTION

As previously noted, the present invention relates to a process for regenerating a sulfur capturing additive which is added to a sulfur containing hydrocarbon material which is to be burned as a fuel. The process is particularly useful for fuels in the form of hydrocarbon in water emulsions as disclosed in co-pending applications Ser. Nos. 014,871 and 875,450 which disclosures are incorporated herein by reference. It has been found that the formation and emission of sulfur oxides during the combustion of hydrocarbon fuels including oil in water emulsions can be controlled by adding an additive which captures sulfur during the combustion of the fuel. The preferred additives for use in the process are water soluble and are selected from the group consisting if $Na^+$, $K^+$, $LI^+$, $Ca^{++}$, $Ba^{++}$, $Mg^{++}$, $Fe^{+++}$ and mixtures thereof. The additive should be added to the hydrocarbon or emulsion in a molar ratio amount of additive to sulfur in said hydrocarbon so as to obtain $SO_2$ emissions upon combustion of the emulsion of less than or equal to 1.50 lb/MMBTU. It has been found that in order to obtain the desired emissions level the additive must be present in a molar ratio of additive to sulfur of greater than or equal to 0.050, preferably 0.100, in the hydrocarbon in water emulsion. While the level of additive to obtain the desired result depends on the particular additive or combination of additives employed it has been found that a molar ratio of at least 0.050 of additive to sulfur is required. A complete discussion of the results obtained vis-a-vis sulfur emissions as a result of use of these additives can be found in the aforementioned applications which are incorporated herein. The present invention is drawn to a process for regenerating these sulfur capturing additives.

Referring to the drawing, a fuel 12 to be combusted is delivered via line 14 to a boiler 16. In accordance with the present invention the fuel may be a hydrocarbon residual, a crude or an oil in water emulsion formed from a viscous hydrocarbon or other residual hydrocarbon. In accordance with the present invention, a sulfur capturing additive 18 is admixed with the hydrocarbon fuel, particularly an oil in water emulsion, via line 20 prior to delivering the fuel to boiler 16 for combustion. The preferred sulfur capturing additives for use in the process are water soluble and are selected from the group consisting of $Na^+$, $K^+$, $Li^+$, $Ca^{++}$, $Ba^{++}$, $Mg^{++}$, $Fe^{+++}$ and mixtures thereof. After combustion of the fuel in boiler 16 the overhead gases are delivered via line 22 to an electrostatic separator 24 wherein a combustion ash is separated from the exhaust gases which are delivered off via line 26. The combustion ash is delivered via line 28 to a leaching zone 30 wherein the combustion ash is leached with water delivered via line 32 in order to dissolve the water soluble sulfur capturing additive which, after fuel combustion, is in the form of a sulfate.

In accordance with the present invention the combustion ash is leached with water in a water to ash ratio in milliliters to grams of from 1:1 to 30:1, preferably 2:1 to 10:1. The leaching operation is carried out at a temperature of from about 5° to 200° C., preferably 15° to 95° C. It is preferred for operating temperatures less than 100° C. to operate the leaching step at a pressure of 1 atm. The required time for leaching is from about 0.1 to 5 hours, preferably 0.2 to 3 hours. After leaching the solution is withdrawn via line 34 to a separator 36 wherein the pregnant leach liquor is separated from the solid residual and delivered via line 38 to precipitation zone 40. The solid residual is delivered via line 42 for further treatment in leaching zone 44 as will be discussed hereinbelow.

In precipitation zone 40 the pregnant leach liquor is adjusted with a base precipitating agent via line 46 so as to precipitate the sulfur capturing additive as a compound. Suitable base precipitating agents include $NH_4OH$, NaOH, $Ca(OH)_2$, $NaCO_3$ and mixtures thereof. The base precipitating agent is added in an amount sufficient to adjust the pH of the solution to greater than 7 and, preferably to a pH of between 9 and 11. The precipitation operation takes place at a temperature range of from 5° to 95°, preferably 25° to 80° C. The precipitated solution is thereafter delivered via line 48 to separation stage 50 wherein the precipitant is separated from the liquid phase which can be discharged via line 52. Depending on the base precipitating agent employed in precipitation zone 40, the precipitant and liquid derived in separation stage 50 will be different. For example, if NaOH is used as the precipitating agent, the precipitate will be in a relatively pure hydroxide form. For example if Mg was used as the sulfur capturing additive, the precipitate is $Mg(OH)_2$. If $NH_4OH$ is used as the precipitating agent the precipitant will again be a hydroxide in relatively pure form. In this case the liquid discharged via line 52 will contain ammonium sulfate which is useful, for example, as a fertilizer and which can be recovered from the reactor via known crystallization processes. Finally, if $NaCO_3$ is employed as the precipitating agent, the resulting precipitant is an impure mixture of a carbonate and sulfate which in the case of a Mg additive would be $MgCO_3$ and $Na_2SO_4$. It has been found that either of the above base precipitating agents results in over 90% of the sulfur capturing additive being precipitated with NaOH precipitating 99.9%, $NH_4OH$ precipitating 93% and $NaCO_3$ precipitating 96%.

The sulfur capturing additive compound separated in separator 50 may be delivered as desired via line 54 back to line 20 for admixing with the hydrocarbon fuel in line 14. In accordance with the present invention, it is desirable that the sulfur capturing additive be in the form of a carbonate. In order to achieve the foregoing, the sulfur capturing additive compound is delivered from separation stage 50 via line 56 to a closed vessel 58 where the additive hydroxide compound is treated with water and $CO_2$ gas via lines 60 and 62. The $CO_2$ is added to vessel 58 and the sulfur capturing additive hydroxide compound at a $CO_2$ partial pressure of up to 1000 psi, preferably between 1 and 500 psi at a temperature of from 0° to 150° C. The mixture is agitated in the closed vessel 58 and a sulfur capturing additive carbonate is removed from the vessel in solution and can be recycled via line 64 for addition to the hydrocarbon fuel.

As noted above, the solid residual from separation zone 36 can be treated in leaching zone 48 so as to recover vanadium and nickel. A solid residual is dissolved with an acid solution delivered via line 66. A suitable acid solution is, for example, a 20% solution of $H_2SO_4$. After the acid leaching wherein the solid mixture is dissolved, the solution is delivered via line 68 to separation zone 70 wherein the solid waste is carried off via line 72 and the pregnant liquor is delivered via line 74 to a metal precipitating zone 76 where the vanadium is precipitated by adjusting the pH of the solution to about 2. Thereafter, nickel can be precipitated by adjusting the pH of the liquor to 5 to 6.

It should be appreciated that the following example is given for purposes of illustrating the process of the present invention and it is to be understood that this example is not intended to limit the generally broad scope of the present invention as claimed.

An oil in water emulsion was prepared by admixing a sulfur containing hydrocarbon and water with an emulsifier. A water soluble additive in the form of a magnesium salt ($MgCl_2$) was added to the emulsion in an amount with respect to the hydrocarbon such that the molar ratio of magnesium to sulfur was equal to 0.100. The resultant emulsion was burned leaving behind a combustion ash containing magnesium sulfate. 1000 grams of ash were leached with 5000 ml of water (a ratio of ash to water of 5:1) for two hours at a temperature of 90° C. The solution was then separated by filtration leaving a solid residue of 300 grams indicating that 70% of the magnesium originally present in the ash went into solution.

Three 100 ml samples of the pregnant leach liquor recovered above were reserved and labelled Sample I, Sample II and Sample III, respectively. Sample I was mixed with 61 ml of a base precipitating agent in the form of a 10% solution of $N_2OH$ at a temperature of 80° C. at 1 atm pressure. The precipitation of Mg was almost instantaneous. 99.9% of the Mg present in the pregnant leach liquor was precipitated and identified by X-ray diffraction as relative pure $Mg(OH)_2$. Sample II was mixed with 61 ml of a base precipitating agent in the form of a 10% solution of $NH_4OH$ at a temperature of 80° C. at 1 atm pressure. 93% of the Mg present in the liquor was precipitated and identified by X-ray diffraction as relative pure $Mg(OH)_2$. In addition, ammonium sulfate was recovered from the liquor via crystallization. Finally, Sample III was mixed with 61 ml of $NaCO_3$ as precipitating agent at the same pressure and temperature as Sample I and II. 96% of the Mg was precipitated. The precipitate was identified by X-ray diffraction and was found to be an impure mixture of $MgCO_3$ and $Na_2SO_4$. The regenerate and recycle the $Mg(OH)_2$ precipitate obtained above, the precipitate was dissolved in a closed vessel with mechanical agitation and $CO_2$ gas was injected at a partial pressure of 30 psi at 25° C. to yield $MgCO_3$.

100 g of the solid residue from the water leaching step of the original combustion ash was leached with 500 ml of 20% solution of $H_2SO_4$ at 80° C. for 2 hours. After leaching 88% of the residue was dissolved and all vanadium and nickel in the residue was solubilized. The resulting liquid was separated and vanadium was precipitated by adjusting the pH of the solution to 2 with HCL. Thereafter the pH was adjusted to 6 to precipitate nickel.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for regenerating a sulfur capturing additive used in the preparation of a hydrocarbon in water emulsion for combustion as a fuel comprising:

(a) forming a hydrocarbon in water emulsion by admixing a sulfur containing hydrocarbon and water with an emulsifier and a water soluble sulfur capturing additive wherein said sulfur capturing additive is selected from the group consisting of $Na^+$, $K^+$, $Li^+$, $Ca^{++}$, $Ba^{++}$, $Mg^{++}$, $Fe^{+++}$ and mixtures thereof;

(b) burning said emulsion so as to form a combustion ash containing said water soluble additive as a sulfate compound;

(c) leaching said combustion ash wherein said combustion ash is leached with water in a water to ash ratio in ml to grams of 1:1 to 30:1 so as to dissolve said water soluble additive sulfate compound to form a pregnant leach liquor containing said additive;

(d) separating said pregnant leach liquor containing said additive;

(e) adjusting said pregnant leach liquor with a base precipitating agent wherein said base precipitating agent is selected from the group consisting of $NH_4OH$, NaOH, $Ca(OH)_2$, $NaCO_3$ and mixtures thereof wherein said pregnant leach liquor is adjusted with said base to a pH of greater than 7 so as to precipitate an additive compound; and (f) recovering said additive compound.

2. A process according to claim 1 including the step of:

(g) recycling and admixing said additive compound with said hydrocarbon in water emulsion prior to combustion of same as a fuel.

3. A process according to claim 1 wherein said additive compound is a hydroxide.

4. A process according to claim 3 including the step of:

(g) mixing said additive hydroxide compound with water and carbon dioxide so as to form an additive carbonate compound.

5. A process according to claim 4 including the step of:

(h) recycling and admixing said additive carbonate compound with said hydrocarbon in water emulsion prior to combustion of same as a fuel.

6. A process according to claim 1 wherein said hydrocarbon contains metals which are separated from said pregnant leach liquor in step (c) as a solid residue.

7. A process according to claim 6 including the steps of:

(g) mixing said solid residue with an acid solution so as to dissolve said metals; and (h) precipitating said metals by adjusting the pH of said acid solution to between 2 to 6.

8. A process according to claim 7 including the steps of:

(i) adjusting the pH to about 2; and (j) thereafter adjusting the pH to between 5 and 6.

9. A process according to claim 1 including the step of:

(g) recovering ammonium sulfate from step (e) via crystallization.

10. A process according to claim 1 wherein said combustion ash is leached with water in a water to ash ratio in ml to grams of 2:1 to 10:1.

11. A process according to claim 1 wherein said combustion ash is leached at a temperature of 5° to 200° C.

12. A process according to claim 10 wherein said combustion ash is leached at a temperature of 15° to 95° C.

13. A process according to claim 11 wherein said combustion ash is leached for between 0.1 to 5 hours.

14. A process according to claim 13 wherein said combustion ash is leached for between 0.2 to 3 hours.

15. A process according to claim 1 wherein said pregnant leach liquor is adjusted with said base to a pH of between 9 to 11.

16. A process according to claim 1 wherein said additive compound is precipitated at a temperature of 5° to 95° C.

17. A process according to claim 1 wherein said additive compound is precipitated at a temperature of 25° to 80° C.

18. A process according to claim 4 wherein said carbon dioxide is added to said additive hydroxide compound in a closed vessel at a temperature of 0° to 150° C. at a $CO_2$ partial pressure of up to 1000 psi.

19. A process according to claim 4 wherein said carbon dioxide is added to said additive hydroxide compound in a closed vessel at a temperature of 3° to 95° C. at a $CO_2$ partial pressure of 1 to 500 psi.

20. A process according to claim 18 including agitating said closed vessel.

21. A process according to claim 19 including agitating said closed vessel.

22. A process according to claim 7 wherein said acid solution is a 2 to 30% sulfuric acid solution and is added in a solution to solid residue ratio in ml to grams of 1:1 to 30:1.

23. A process according to claim 7 wherein said acid solution is a 2 to 30% sulfuric acid solution and is added in a solution to solid residue ratio in ml to grams of 2:1 to 10:1.

24. A process according to claim 22 including the steps of:.

(i) adjusting the pH to about 2; and (j) thereafter adjusting the pH to between 5 and 6.

25. A process according to claim 23 including the steps of:

(i) adjusting the pH to about 2; and (j) thereafter adjusting the pH to between 5 and 6.

26. A process for recovering a sulfur capturing additive from a combustion ash comprising:

(a) leaching said combustion ash wherein said combustion ash is leached with water in a water to ash ratio in ml to grams of 1:1 to 30:1 so as to dissolve said sulfur capturing additive to form a pregnant leach liquor containing said additive wherein said sulfur capturing additive is selected from the group consisting of $Na^+$, $K^+$, $LI^+$, $Ca^{++}$, $Ba^{++}$, $Mg^{++}$, $Fe^{+++}$ and mixtures thereof;

(b) separating said pregnant leach liquor containing said additive;

(c) adjusting said pregnant leach liquor with a base precipitating agent wherein said base precipitating agent is selected from the group consisting of $NH_4OH$, $Na^{OH}$, $Ca(OH)_2$, $NaCO_3$ and mixtures thereof wherein said pregnant leach liquor is adjusted with said base to a pH of greater than 7 so as to precipitate an additive compound; and (d) recovering said additive compound.

27. A process according to claim 26 wherein said additive compound is a hydroxide.

28. A process according to claim 27 including the step of:

(g) mixing said additive hydroxide compound with water and carbon dioxide so as to form an additive carbonate compound.

29. A process according to claim 27 wherein said additive compound is ammonium hydroxide.

30. A process according to claim 29 including the step of:

(g) recovering ammonium sulfate from step (e) via crystallization.

31. A process according to claim 26 wherein said pregnant leach liquor is adjusted with said base to a pH of between 9 to 11.

32. A process according to claim 28 wherein said carbon dioxide is added to said additive hydroxide compound in a closed vessel at a temperature of 0° to 150° C. at a $CO_2$ partial pressure of up to 1000 psi.

33. A process according to claim 28 wherein said carbon dioxide is added to said additive hydroxide compound in a closed vessel at a temperature of 3° to 95° C. at a $CO_2$ partial pressure of 1 to 500 psi.

34. A process according to claim 32 including agitating said closed vessel.

35. A process according to claim 33 including agitating said closed vessel.

* * * * *